US007313839B2

(12) United States Patent
Shinler

(10) Patent No.: US 7,313,839 B2
(45) Date of Patent: Jan. 1, 2008

(54) SWEEPING SYSTEM WITH FRONT REMOVABLE HOPPER

(75) Inventor: Kevin L. Shinler, North Branch, MN (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 10/159,727

(22) Filed: May 29, 2002

(65) Prior Publication Data

US 2002/0179116 A1 Dec. 5, 2002

Related U.S. Application Data

(60) Provisional application No. 60/294,298, filed on May 29, 2001.

(51) Int. Cl.
*A47L 11/24* (2006.01)

(52) U.S. Cl. ..... 15/49.1; 15/83; 15/87

(58) Field of Classification Search ..... 15/78, 15/87, 83, 85, 49.1, 52.1, 52.2, 340.3, 340.4, 15/340.2, 320, 41.1, 79.2
See application file for complete search history.

(56) References Cited

U.S. PATENT DOCUMENTS 2,972,159 A * 2/1961 Kimmerle et al. ..... 15/340.4
3,204,280 A 9/1965 Campbell ..... 15/314
3,604,051 A * 9/1971 Wendel et al. ..... 15/340.4
4,492,002 A 1/1985 Waldhauser et al. ..... 15/320
4,757,566 A 7/1988 Field et al. ..... 15/49
5,239,720 A 8/1993 Wood et al. ..... 15/4
5,481,776 A 1/1996 Briscoe ..... 15/49.1
5,615,437 A 4/1997 Takahashi et al. ..... 15/98
5,943,724 A 8/1999 Erko et al. ..... 15/49.1
6,000,084 A * 12/1999 Briscoe ..... 15/49.1
6,163,915 A 12/2000 Kaczmarz et al. ..... 15/49.1
6,249,926 B1 * 6/2001 Wulff ..... 15/50.1

FOREIGN PATENT DOCUMENTS

EP 705558 A1 4/1996
WO 0074549 12/2000

OTHER PUBLICATIONS

PCT International Search Report, dated Nov. 26, 2002, 4 pages.

* cited by examiner

*Primary Examiner*—Mark Spisich
(74) *Attorney, Agent, or Firm*—Fulbright & Jaworski L.L.P.

(57) ABSTRACT

A surface maintenance apparatus is described, having a sweeping system positioned near the front or leading edge of the apparatus. The sweeping system includes a plurality of brushes and a removable hopper for collecting debris. The sweeping system is capable of being raised off the surface being maintained when the sweeping system encounters an obstacle or irregularity on the surface. The brushes are pivotally mounted to the surface maintenance apparatus to allow the brushes to be rotated away from each other, providing access to the removable hopper from the front end of the surface maintenance apparatus.

11 Claims, 9 Drawing Sheets

FIG. 4 OPERATIVE CONDITION

FIG. 5 TRANSPORT CONDITION

SWEEPING SYSTEM WITH FRONT REMOVABLE HOPPER

RELATED APPLICATION

This application claims the benefit of priority U.S. Provisional Patent Application No. 60/294,298, filed on May 29, 2001, the disclosure of which is incorporated in its entirely by reference herein.

FIELD OF THE INVENTION

The present invention relates generally to surface maintenance or conditioning machines, and particularly those machines employing one or more surface maintenance or conditioning appliances or tools that perform one or more tasks including, among others, scrubbing, sweeping, and polishing or burnishing. More specifically, the present invention is particularly directed to a sweeper system for such surface conditioning machines.

BACKGROUND OF THE INVENTION

Surface maintenance machines that perform a single surface maintenance or surface conditioning task are well known. Surface maintenance machines are generally directed to applications such as floor surfaces, or simply floors. The term floor, as used herein, refers to any support surface, such as, among others, floors, pavements, road surfaces, ship decks, and the like.

Commonly, floor or surface maintenance machines are constructed having a single surface conditioning appliance or system so as to only sweep, others to scrub, while still others only to polish or burnish. It is possible to construct a single surface maintenance machine to perform one or more of the aforementioned surface maintenance tasks.

One example of a multi-task floor conditioning machine is disclosed in U.S. Pat. No. 3,204,280, entitled, "Floor Cleaning & Waxing Machine," issued to Campbell, the entire disclosure of which is incorporated by reference herein in its entirety for any and all purposes. Another is disclosed in U.S. Pat. No. 4,492,002, entitled, "Floor Cleaning Machine," in name of inventors Waldhauser, et al., the entire disclosure of which is incorporated by reference herein in its entirety for any and all purposes. Disclosed therein is a forward sweeper assembly followed by a scrubber assembly that is followed by a squeegee assembly.

Yet, another example of a multi-task floor conditioning machine is disclosed in a PCT application having publication number WO 00/74549, published Dec. 14, 2000, entitled "Floor Cleaning Machine," in name of inventors Thomas, et al., the entire disclosure of which is incorporated by reference herein in its entirety for any and all purposes. The machine disclosed therein performs the task of sweeping, scrubbing, and burnishing, and includes a squeegee assembly in combination with a vacuum system for removing cleaning solution from a floor subsequent to a cleaning and scrubbing operation.

As illustrated in WO 00/74549, thereshown is a single unitary walk-behind machine that is transportable across a floor. Successively attached to the machine, from front to back, are independent floor maintenance systems. At the forward section of the machine is a sweeping system. At the rearward section of the machine, near the machine steering control, is a burnishing system. In between the sweeping system and the burnishing system is a scrubbing system including forward scrubbing brushes coupled to a cleaning solution dispensing system and rearward following squeegees coupled to a liquid vacuum system for recovering expended cleaning solution.

Burnishing systems generally include a scheme for controlling the degree of burnishing applied to a floor surface depending upon the type of floor surface intended to be burnished. Burnishing systems well known in the art commonly include a driver assembly which includes a working appliance or tool such as a pad or brush affixed to a driver that is rotatably driven by a driver motor. The driver assembly of the burnishing systems of the prior art have been selectively raised and lowered by an actuator so as to achieve an intended force or pressure against a floor surface intended to be polished or burnished.

Scrubbing systems are analogous to burnishing systems, and are also well known in the art. Scrubbing systems commonly include a driver assembly including rotatable scrubber in the form of a brush, pad, or the like, and a scheme for controlling the degree of scrubbing applied to a floor surface depending upon the type of floor surface intended to be scrubbed. Too much scrubbing of course may deleteriously affect the floor surface requiring further maintenance. The scrubber driver assemblies for scrubbing systems, like burnishing systems, are well known in the art and commonly include one or more rotatable brushes driven by a driver motor affixed to a scrubber head. Scrubber heads of the prior art have been selectively raised and lowered by an actuator coupled to the driver so as to achieve an intended force or pressure of the brush against a floor surface intended to be scrubbed. Examples of the latter are taught in U.S. Pat. Nos. 4,757,566; 4,769,271; 5,481,776; 5,615,437; 5,943,724; and 6,163,915, the entire disclosures of which are incorporated by reference herein in their entirety for any and all purposes.

Sweeper systems are also analogous to burnishing systems. Sweeper systems commonly include a rotatable sweeper system brush driven by a driver motor. Like burnishing and scrubbing systems, the sweeper system brush may be lowered and raised relative to a floor, which may more or less affect the floor surface.

As illustrated in the multi-task surface conditioning machine disclosed in the aforementioned publication WO 00/74549, a sweeper system is strategically located at the forward section of the machine prior to the scrubbing and burnishing systems located in the mid section, and aft section of the surface conditioning machine, respectively. This is so since it is desirable to remove any surface debris prior to a scrubbing operation. Since the sweeping system is positioned at the front of the machine, this necessitates a debris collection container or the like to be located at a position following the selected sweeper mechanism, i.e., a brush system or the like.

Locating a sweeper system at the forward section of a surface conditioning machine necessitates the consideration of surface obstacles and surface irregularities. This is so since such surface obstacles and surface irregularities may damage the sweeper system.

Locating a sweeper system at the forward section of a surface conditioning machine further necessitates consideration of machine maintenance and ease of use for emptying a debris collection container.

SUMMARY OF THE INVENTION

An object of the present invention is to provide a sweeper system located at the forward section of a surface conditioning machine.

Another object of the present invention is to provide a sweeper system located at the forward section of a multi-task surface conditioning machine.

Another object of the present invention is to provide a sweeper system that is minimally affected by surface obstacles and surface irregularities.

Yet another object of the present invention is to provide a sweeper system that provides ease of use and access to a debris collection container.

In accordance with the present invention, a pair of independent rotatable brushes are located at the forward section of a surface conditioning machine. A front removable hopper is centrally positioned in relation to the pair of independent rotatable brushes. The sweeping system, including the brushes and hopper, is coupled to a 4-point suspension system operative for momentarily raising the combination of sweeper brushes and hopper when the hopper forcibly comes in contact with a surface obstacle or irregularity.

DETAILED DESCRIPTION OF THE INVENTION

Figure 1:
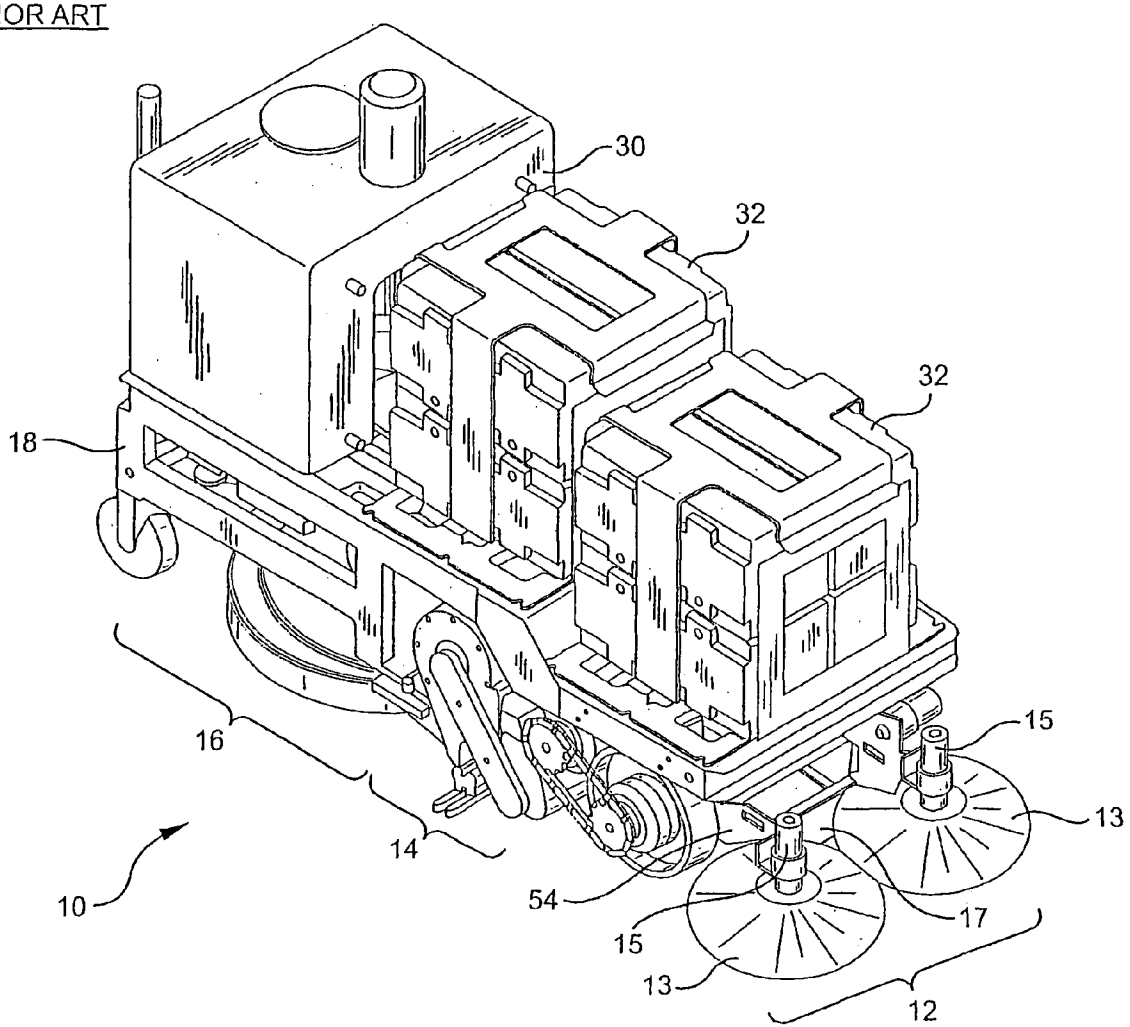
FIG. 1 PRIOR ART
FIG. 1 is a perspective view of a multi-task surface maintenance machine of the prior art illustrating a front sweeper system followed by a scrubber system, followed by a burnishing system and as illustrated in WO 00/74549.
Figure 2:
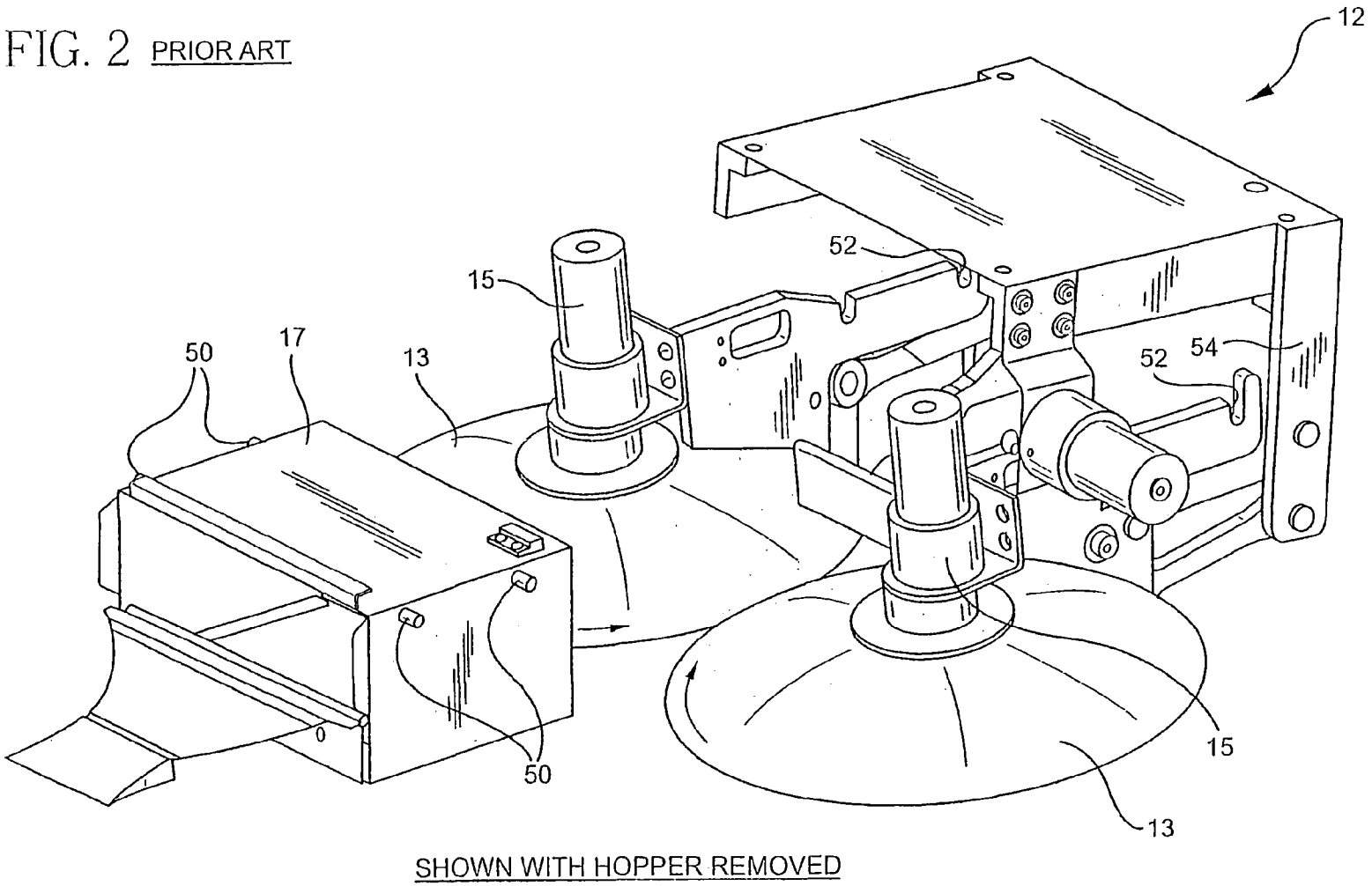
FIG. 2 PRIOR ART
FIG. 2 is a perspective view of the prior art sweeper system illustrated in WO 00/74549.

Illustrated in FIG. 1 is a walk behind surface conditioning machine 10 known in the art and as disclosed in WO 00/74549. A burnishing assembly generally indicated by numeral 16, scrubbing assembly 14, and sweeping assembly 12 are separately controlled and suspended from a frame 18 by way of independent suspension systems, not shown. Sweeping system 12 includes a pair of disk brushes 13 for sweeping debris into a rearward hopper 17. Each brush 13 is secured to a frame portion 54 and is independently powered by a drive motor 15. FIG. 2 more particularly illustrates sweeper system 12 including hopper 17. Hopper 17 is attached to frame 54 by way of pins 50 and retainers 52.

Illustrated in FIGS. 3-6 are various perspectives, views, and drawings of one embodiment of the sweeper and hopper system in accordance with the present invention. An embodiment of the present invention may be utilized with a walk behind surface conditioning machine, such as disclosed in WO 00/74549, to replace the sweeping system 12 therein disclosed.

Figure 3:
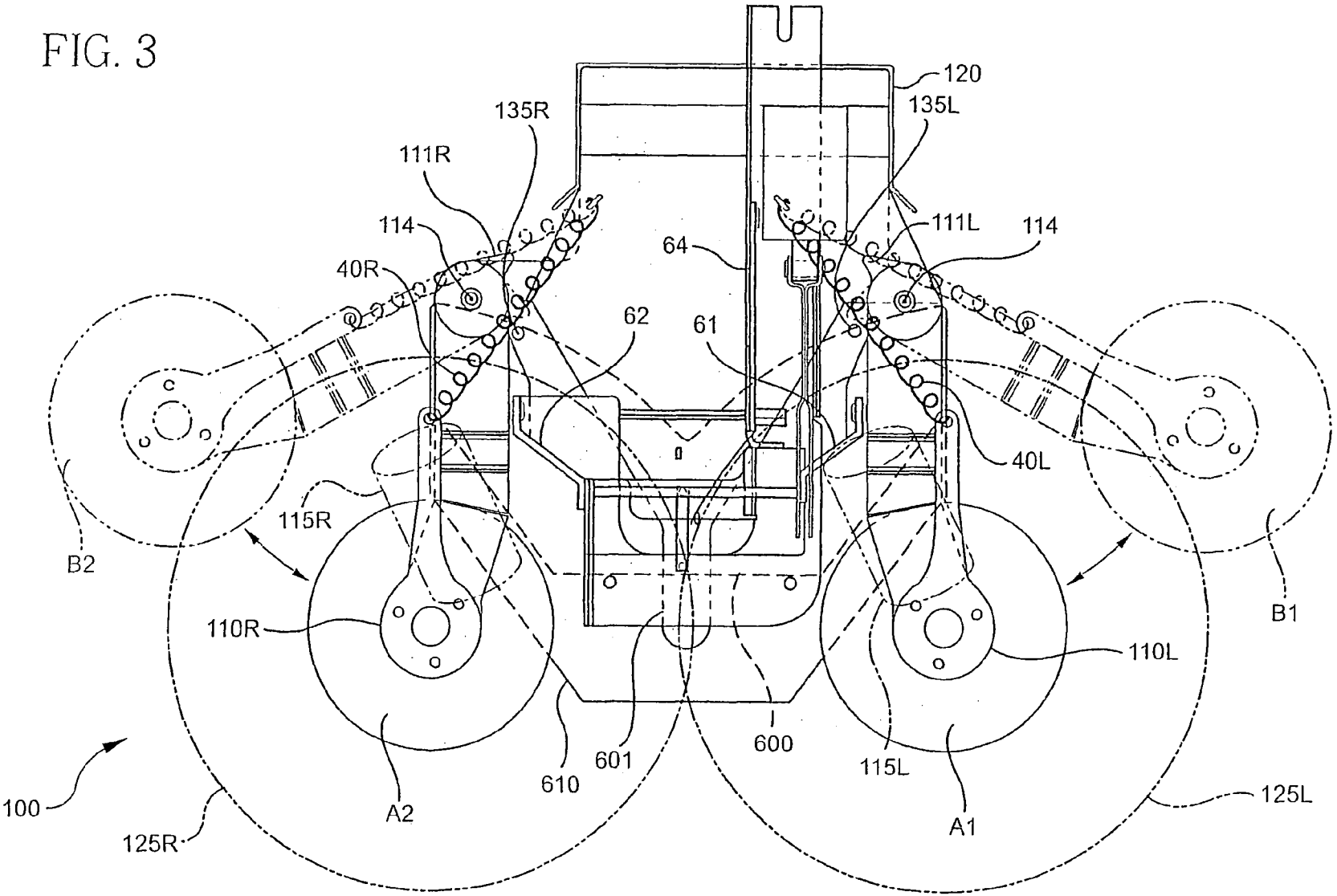
FIG. 3 is a wire design drawing illustrating a top plan view of the sweeper system in accordance with the present invention.

Referring to FIG. 3, an improved sweeper and hopper system is indicated as numeral 100. Generally, sweeper and hopper system 100 includes a pair of rotatable brushes 125 and a hopper 600 for receiving debris from brushes 125. Brushes 125 are driven by suitable drive means, including electric and/or hydraulic motors. In the illustrated embodiment, brushes 125 are driven by electric motors 115. As described in more detail herein, brushes 125 are connected to the machine by a selective coupling device to allow access and removal of hopper 600 at a forward machine portion.

Figure 4:
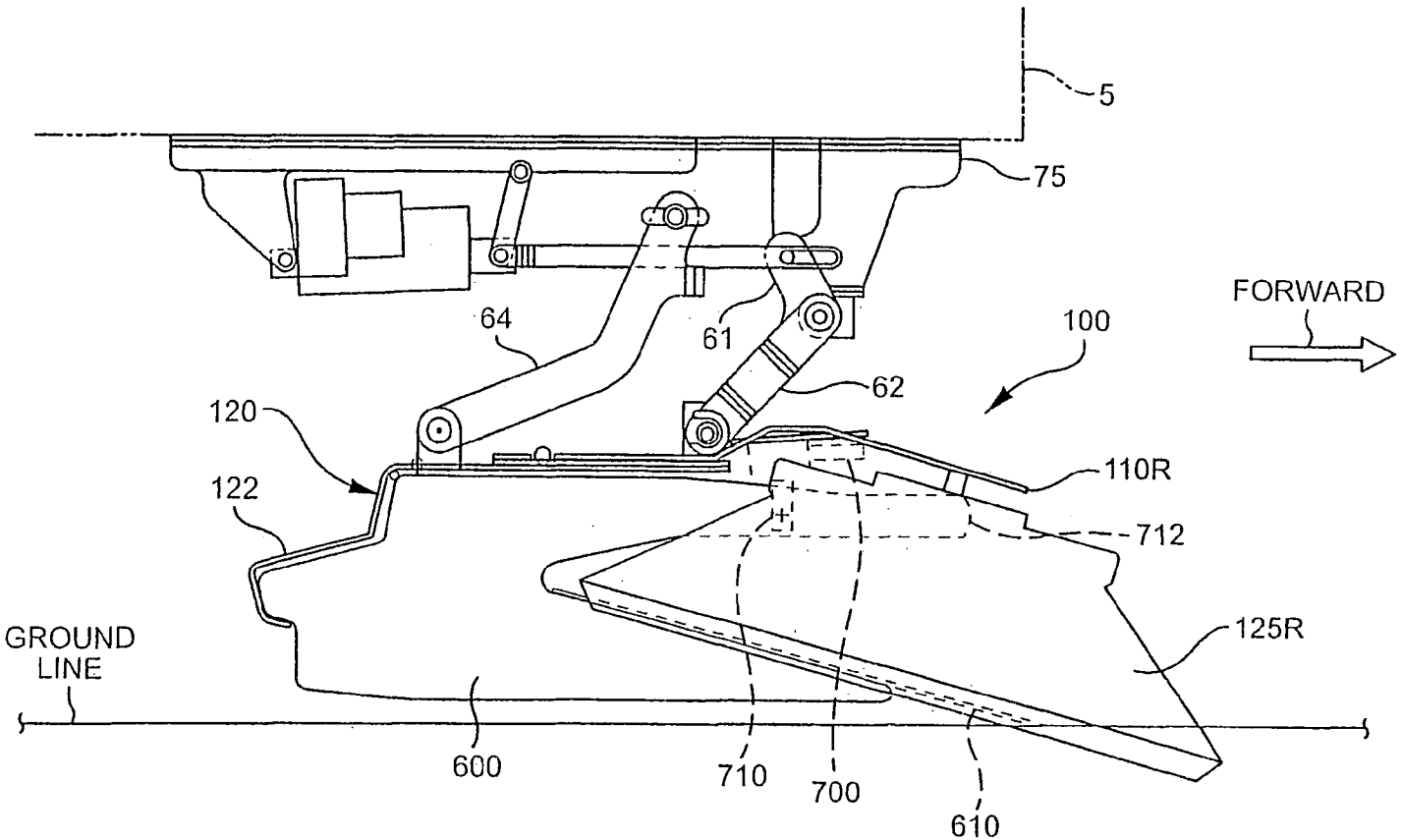
FIG. 4 is a wire design drawing illustrating a side view of the sweeper system in accordance with the present invention.
Figure 5:
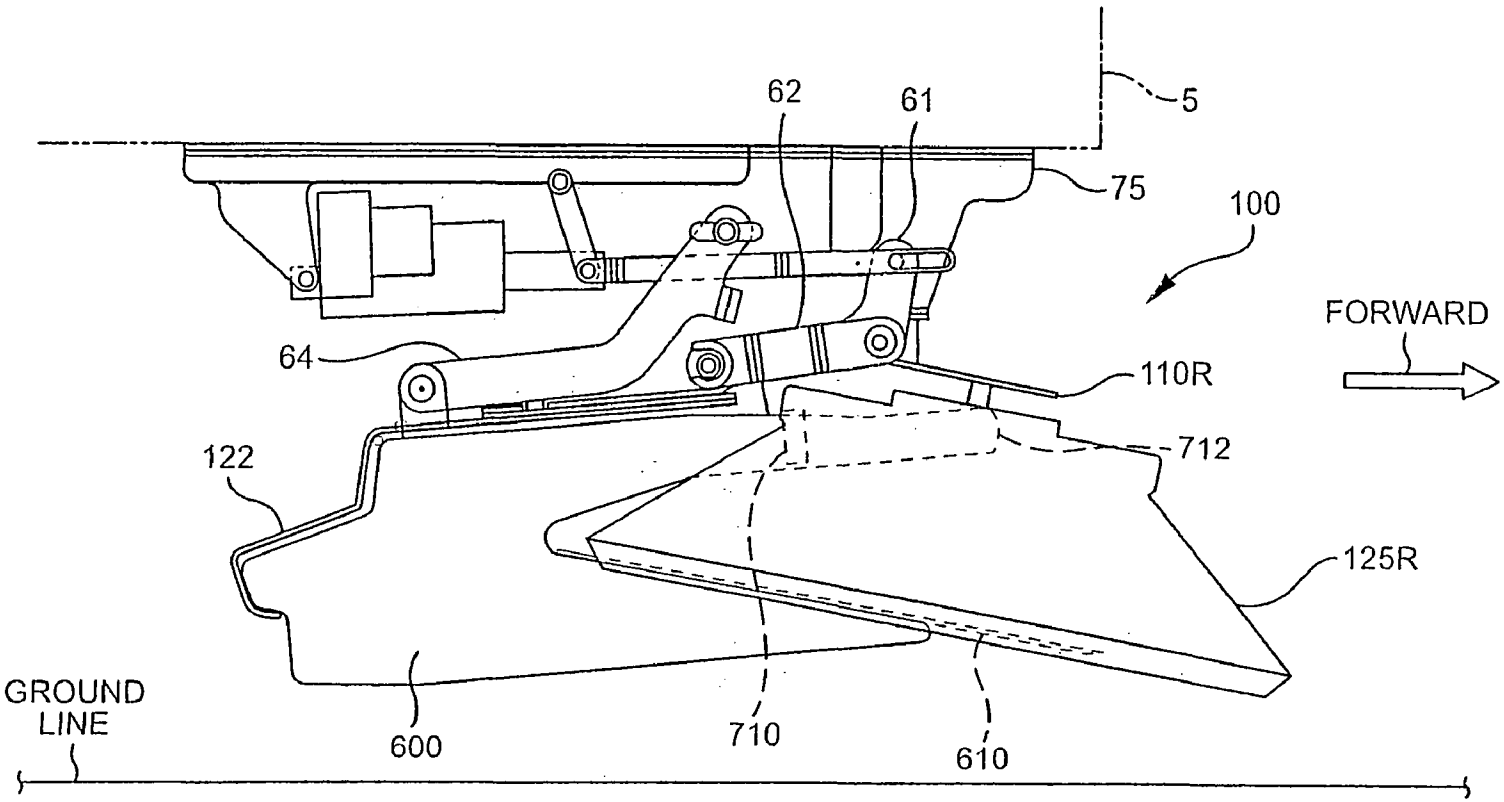
FIG. 5 is a wire design illustrating a side plan view of the sweeper suspension system in the transport condition.

Referring to FIGS. 4 and 5, sweeper and hopper system 100 includes a movable carriage for supporting hopper 600 and brushes 125. Sweeper and hopper system 100 is movably coupled to machine by a suspension system including links 61, 62, and 64 which define a four-point, three bar linkage. The suspension system permits sweeper and hopper system to follow undulations in the floor surface and respond to other surface irregularities by temporarily lifting sweeper and hopper system 100 away from the ground surface. FIG. 4 illustrates sweeper and hopper system 100 in an operational orientation wherein brushes 125 are engaging the ground surface. FIG. 5 illustrates sweeper and hopper system 100 in a transport orientation wherein brushes 125 and hopper 600 are lifted away from the ground surface. Additional aspects of the suspension system illustrated in the drawings are disclosed in Applicant's U.S. patent application filed on May 21, 2002, entitled "Suspension Device for Floor Maintenance Appliance" Ser. No. 10/153,408. The entire disclosure of the application being incorporated by reference herein. Referring particularly to FIG. 3, rotatable brushes 125R and 125L are coupled to carriage 120 through movable arms 110. Arms 110L and 110R are pivotally mounted at one end to carriage 120. The other ends of arms 110L and 110R provide mounting members for attaching rotatable brushes 125L and 125R driven by independent drive motors 115L and 115R respectively. FIG. 3 further illustrates (in phantom lines) the range of motion of movable arms 110 and brushes 125. Arms 110 are selectively movable to gain access to hopper 600, as during a hopper emptying procedure. Brush arms 110 are additionally coupled to carriage 120 by way of springs 40R and 40L. As shown in FIG. 3, brush arms 110 are configured so that arms 110 may be swung out from operational position A to displaced position B thereby permitting convenient insertion and removal of the hopper 600. Springs 40 are aligned relative to arm 110 pivot point 114 so that in position A, springs 40 bias arms 110 inwardly, while in position b, springs 40 bias arms 110 outwardly. Arms 110L and 110R stop at locked positions B1 and B2 upon protrusions 111L and 111R engaging stops 135L and 135R respectively. The stop and protrusion combination prevent arms 110L and 110R from over rotating. Movable arms 110L and 110R selectively couple brushes 125L and 125R to carriage 120. Alternative selective coupling devices would be appreciated by those skilled in the relevant arts.

Figure 6:
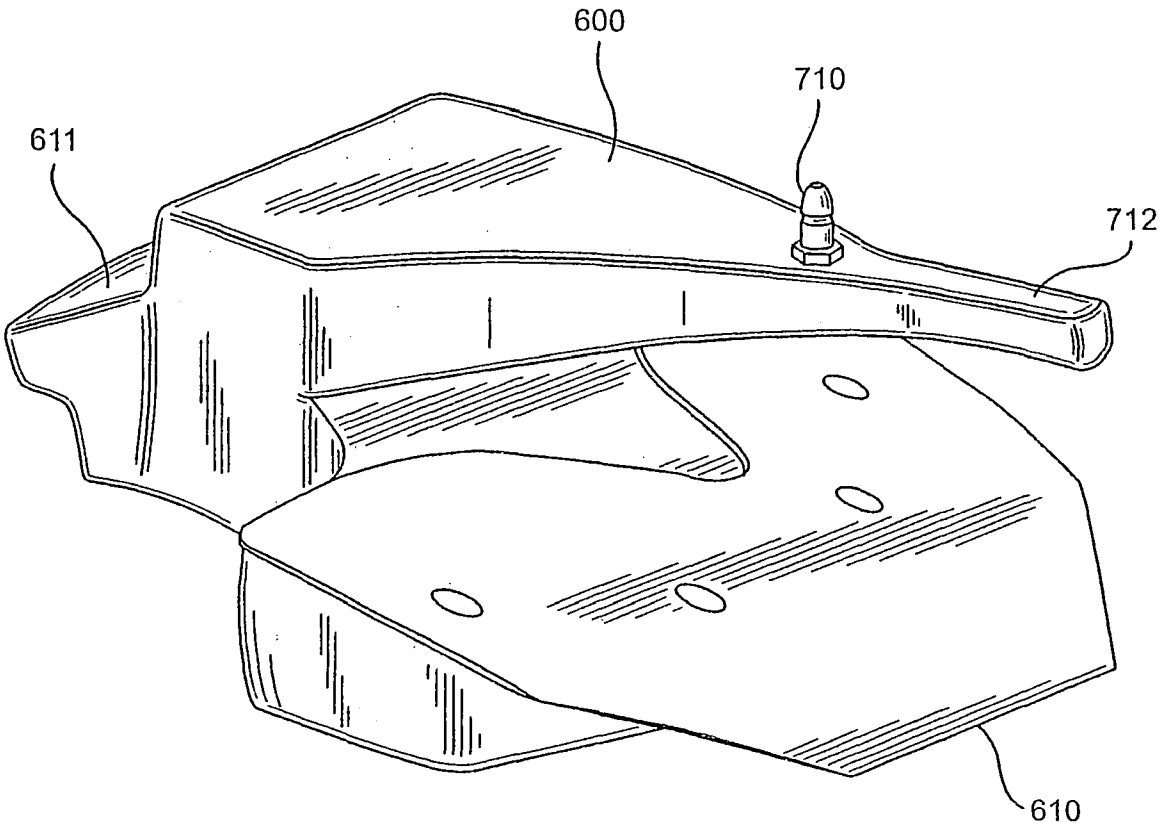
FIG. 6 is a perspective view of a debris hopper.

FIGS. 4 and 5 illustrate a hopper support member 122 secured to carriage 120 for supporting hopper 600 at one end. The other end of hopper 600 is secured to frame member 120 by way of a spring loaded pin arrangement 700 by way of a mating pin 710 secured to hopper 600 as illustrated in FIGS. 3 and 4. FIG. 6 shows a perspective view of a hopper 600 with flexible lip 610. The debris in the hopper pan 600 can be discarded through opening 611. It should be noted that the hopper lip 610 may be integrated with the hopper 600, but is preferably a more flexible or resilient material that may be easily and inexpensively replaced. A hopper handle 712 is provided for ease of hopper 600 manipulation as during removal and emptying procedures.

Hopper 600 is easily accessed by rotating the 125L and 125R brushes away from each other to gain access to the hopper 600 for emptying and re-insertion. Selectively movable brushes 125 permit hopper 600 to be quickly removed, emptied and reinserted into proper orientation without accessory tools.

Figure 7:
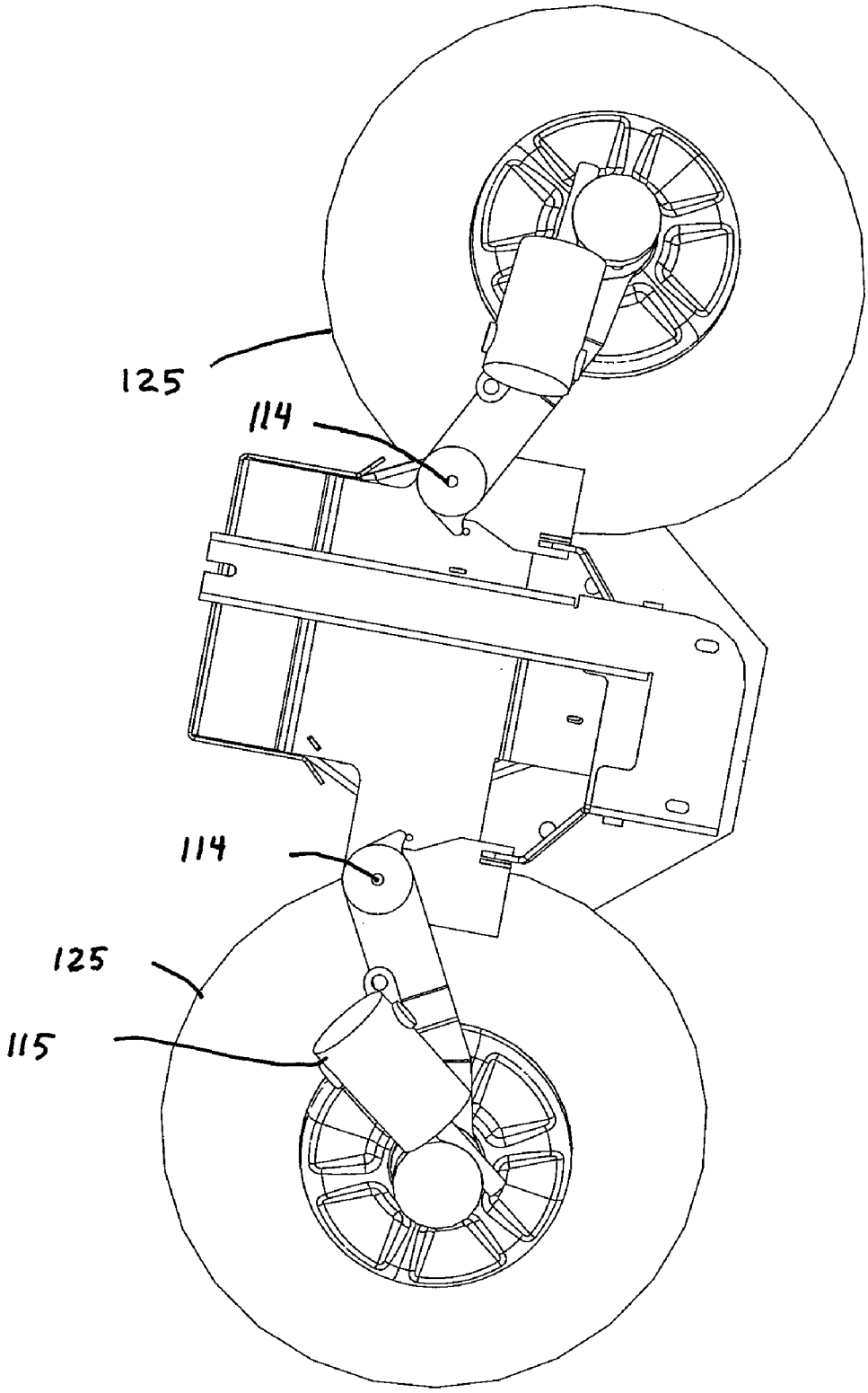
FIG. 7 is a top plan view of the sweeper system of FIG. 3.

FIG. 7 provides a top plan view of the rotatable brushes 125R and 125L coupled to carriage 120 through movable arms 110. Arms 110L and 110R are pivotally mounted at one end to carriage 120. The other ends of arms 110L and 110R provide mounting members for attaching rotatable brushes 125L and 125R. Independent drive motors 115L and 115R are connected near the distal end of the arms 110L and 110R. FIG. 7 shows brush arms 110 that arms 110 swung out from an operational position thereby permitting convenient insertion and removal of the hopper 600.

Figure 8:
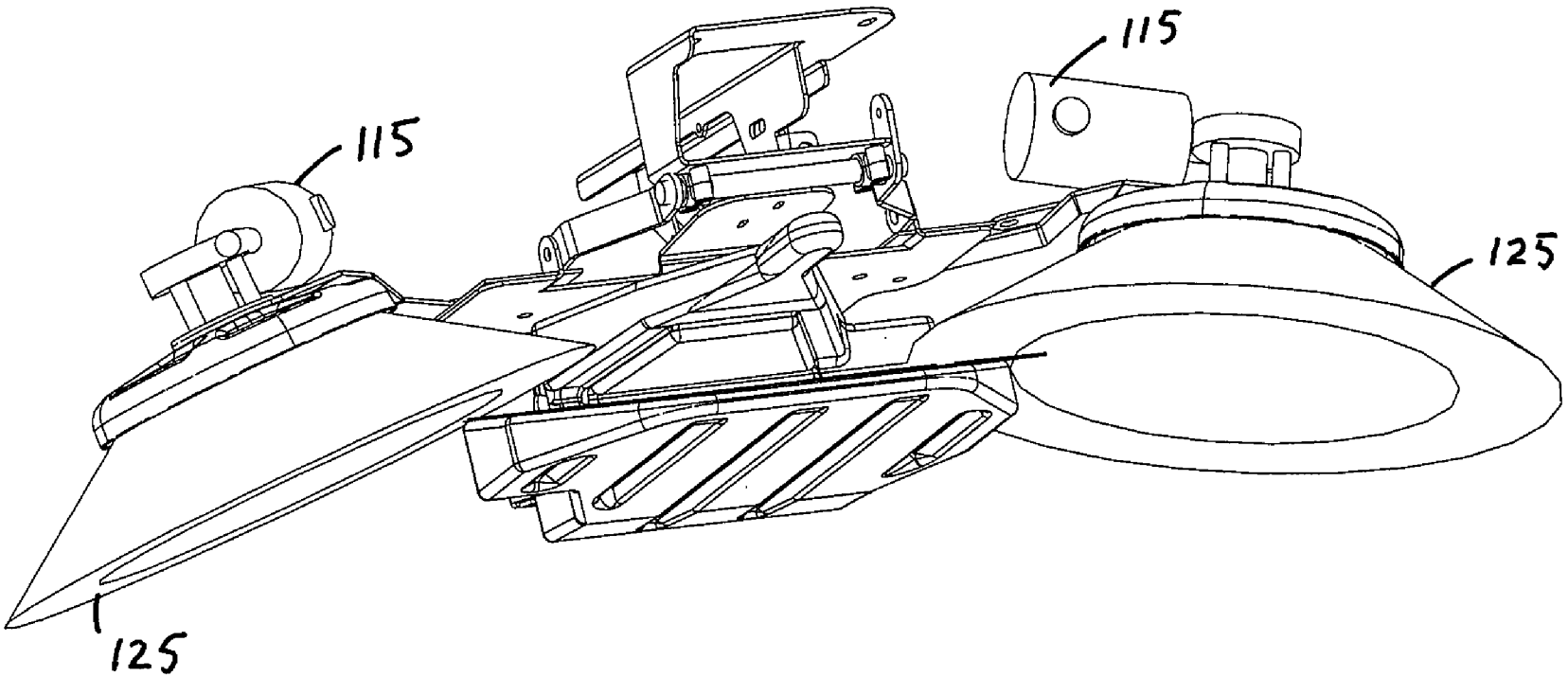
FIG. 8 is a perspective illustration of the sweeper system of FIG. 3

FIG. 8 provides a perspective view of the rotatable brushes 125R and 125L coupled to carriage 120 through movable arms 110. Arms 110L and 110R are pivotally mounted at one end to carriage 120. The other ends of arms 110L and 110R provide mounting members for attaching rotatable brushes 125L and 125R. Independent drive motors 115L and 115R are connected near the distal end of the arms 110L and 110R. FIG. 8 shows brush arms 110 that arms 110 swung out from an operational position thereby permitting convenient insertion and removal of the hopper 600.

Figure 9:
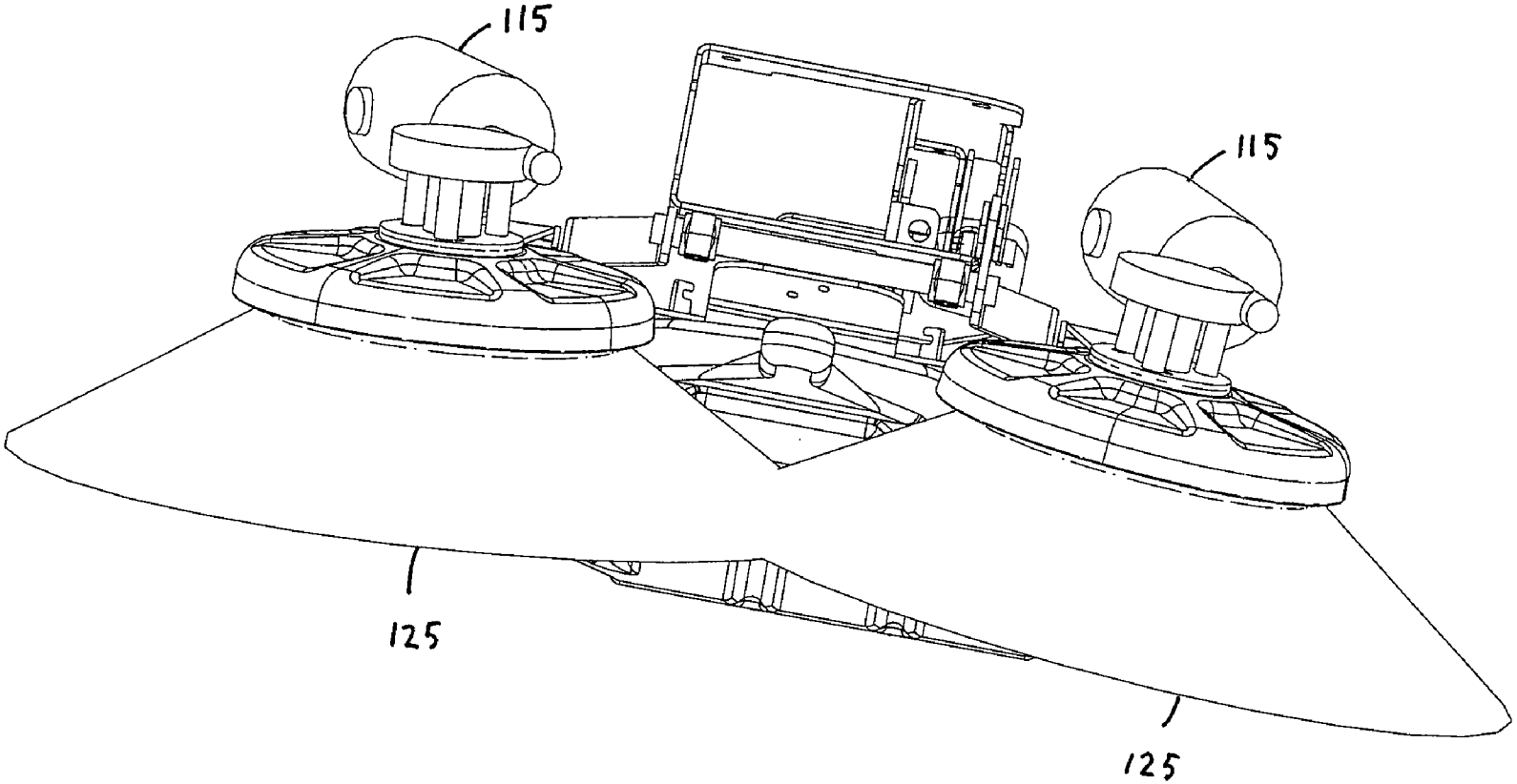
FIG. 9 is a front elevational view of the sweeper system of FIG. 3.

FIG. 9 provides an elevational view of the rotatable brushes 125R and 125L coupled to carriage 120 through movable arms 110. FIG. 9 shows brush arms 110 that arms 110 returned into an operational position thereby blocking removal of the hopper 600. FIG. 9 illustrates drive motors 115L and 115R in different positions relative to the machine centerline as compared to the drive motor positions in FIG. 7.

It is to be understood that the above description is intended to be illustrative, and not restrictive. Many other embodiments will be apparent to those of skill in the art upon reviewing the above description. The scope of the invention should, therefore, be determined with reference to the appended claims, along with the fall scope of equivalents to which such claims are entitled.

What is claimed is:

1. A sweep brush assembly for a surface maintenance machine, said sweep brush assembly comprising:

a rotatable surface engaging brush being connected to the surface maintenance machine by a selective coupling, said selective coupling providing the brush between a first operational orientation and a second displaced orientation, said second displaced orientation being laterally displaced away from a longitudinal centerline of the machine as compared to the first operation condition, said coupling including an arm connected at a proximal end to the machine by a pivot and said brush being coupled to an electric motor connected to a distal end of the arm, during forward movement of said machine said electric motor being closer to a front of said machine than said pivot, wherein the distal end of the arm, electric motor and brush are rotated in a lateral direction away from the machine centerline as the brush is provided in its second displaced orientation; and a hopper in operative relation to the brush to receive debris from the surface when the brush is in its first operational orientation wherein said brush blocks removal of said hopper, said hopper being removable from the surface maintenance machine when the brush is in its second displaced orientation.

2. The sweep brush assembly of claim 1 wherein the selective coupling further comprises a spring for biasing the arm, said spring being connected to the arm.

3. The sweep brush assembly of claim 1 wherein the rotatable surface engaging brush comprises a pair of counter-rotating brushes.

4. The sweep brush assembly of claim 3 wherein each of the pair of counter-rotating brushes is coupled to the machine upon a different movable arm.

5. A sweep brush assembly for a surface maintenance machine, said sweep brush assembly comprising:

a pair of rotatable surface-engaging brushes coupled to a pair of electric motors;

a hopper provided in operative relation to the pair of brushes; and a brush coupling associated with each of the pair of brushes, said brush coupling selectively providing each of the pair of brushes in an operative orientation and a displaced orientation relative to the hopper, wherein when the pair of brushes are in the operative orientation the hopper receives debris from the floor surface and the pair of brushes blocks removal of said hopper from said surface maintenance machine, and when the pair of brushes are in the displaced orientation the pair of brushes are laterally offset relative to the operative orientation and relative to the machine longitudinal centerline so that the hopper can be accessed and removed, wherein the brush coupling comprises a pair of pivotable arms which rotate about a pair of generally vertical axes passing through a pair of pivots at proximal ends of the arms, wherein the electric motors and brushes are at distal ends of the arms, and wherein rotation of the arms about the pivots causes the distal arm ends, electric motors and brushes to displace in a lateral direction away from the hopper and machine centerline.

6. A sweep brush assembly for a surface maintenance machine, said sweep brush assembly including;

a carriage;

a carriage coupling which movably connects the carriage to the surface maintenance machine so that said carriage follows undulations in a floor surface, said carriage coupling allowing vertical displacement of the carriage relative to the floor surface;

a rotatable surface-engaging brush connected to the carriage by a selective brush coupling comprising a movable arm pivotally connected to the carriage at a proximal end, and said brush being coupled to an electric motor at a distal end of the arm, said arm pivoting about a generally vertical axis at the proximal end and providing the brush between a first operational orientation and a second displaced orientation, said displaced orientation providing the brush, electric motor and distal arm end a further lateral distance away from a machine centerline as compared to the first operational orientation; and a removable hopper in operative relation to the brush to receive debris from the surface when the brush is in its first operational orientation, and said brush blocking removal of said hopper from said surface maintenance machine, said hopper being removable when the brush is in its second displaced orientation.

7. A sweep brush assembly of claim 6 wherein the removable hopper is connected to the carriage to follow undulations in the floor surface.

8. The sweep brush assembly of claim 6 wherein the selective coupling further comprises a spring for biasing the movable arm, said spring generating a spring force being transferred to the distal end of the arm.

9. The sweep brush assembly of claim 6 wherein the rotatable surface engaging brush comprises a pair of counter-rotating brushes.

10. A sweep brush assembly for a surface maintenance machine, said sweep brush assembly comprising:

a pair of arms connected at proximal ends to the machine by a pair of pivot connections;

a pair of rotatable surface-engaging brushes coupled to a pair of electric motors at distal ends of the pair of arms; and a hopper provided in operative relation to the pair of brushes, wherein said pair of arms providing each of the pair of brushes in an operative orientation and a displaced orientation relative to the hopper, wherein when the pair of brushes are in the operative orientation the hopper receives debris from the floor surface, and removal thereof is blocked by the brushes and when the pair of brushes are in the displaced orientation the pair of brushes are laterally offset relative to the operative orientation and relative to the machine longitudinal centerline so that the hopper can be accessed and removed, and wherein rotation of the arms about the pivots causes the distal arm ends, electric motors and brushes to displace in a lateral direction away from the hopper and machine centerline, and wherein said electric motors are positioned ahead of said pivots as the surface maintenance machine is operating to perform a sweeping function.

11. The sweep brush assembly of claim 10 further comprising a pair of springs for biasing the arms toward the machine centerline and said pair of springs being connected to the arms.

* * * * *